United States Patent [19]

Korn et al.

[11] Patent Number: 4,655,487

[45] Date of Patent: Apr. 7, 1987

[54] GARAGE DOOR BOLT WITH STATIONARY PROTECTIVE COVER

[75] Inventors: Julius A. Korn, Huntington Beach; Charles H. Schwartz, Los Angeles, both of Calif.

[73] Assignee: Korn Enterprises, Lynwood, Calif.

[21] Appl. No.: 794,657

[22] Filed: Nov. 4, 1985

[51] Int. Cl.[4] ..... E05C 5/02

[52] U.S. Cl. ..... 292/57; 70/128; 70/56

[58] Field of Search ..... 70/6, 11–12, 70/54–56, 128–129, 134; 292/57, 148, 150

[56] References Cited

U.S. PATENT DOCUMENTS

| | | | |
|---|---|---|---|
| 3,953,062 | 4/1976 | Maston | 292/57 |
| 4,437,692 | 3/1984 | Halopoff | 292/57 |

*Primary Examiner*—Robert L. Wolfe

*Attorney, Agent, or Firm*—Charles H. Schwartz; Ellsworth R. Roston

[57] ABSTRACT

A sliding bolt with stationary safety cover for mounting on a door and for locking with a padlock having a bale portion and including the following structure. A back plate for mounting on the door. An upper pair of flange members extending outwardly from the back plate and with each upper flange member including a first opening. A sliding bolt passing through and guided by the first openings in the upper pair of flange members. A lower pair of flange members extending outwardly from the back plate and with each lower flange member including a second opening for receiving the bale portion of the padlock. A handle and locking member attached to the sliding bolt and including a first upwardly extending portion forming a handle for sliding the bolt within the first openings in the upper pair of flange members and including a second downwardly extending portion located between the lower pair of flange members. The handle and locking member having a third opening corresponding to the second openings in the lower pair of flange members and with the third opening in association with either one of the second opening for receiving the bale portion of the padlock to lock the sliding bolt in either of two positions. A stationary safety cover attached across the front of and spaced from the back plate to enclose the sliding bolt, the upper and lower pairs of flanges and the downwardly extending portion of the handle and locking member.

15 Claims, 5 Drawing Figures

GARAGE DOOR BOLT WITH STATIONARY PROTECTIVE COVER

BACKGROUND OF THE INVENTION

1. Field of the Invention

The present invention relates to an apparatus forming a garage door bolt with a stationary safety cover. Specifically, the invention relates to a sliding bolt for a garage door or the like using a padlock to lock the sliding bolt in position.

2. Description of the Prior Art

It is common to use a sliding bolt for locking a garage door or the like and with the sliding bolt retained in either an open or closed position by the use of a padlock. A common structure has the bolt captured for sliding by flanges extending from a back plate. The back plate is mounted to the garage door and the extending flanges include openings to receive the bolt for sliding between the open and closed positions. A hasp is attached to the bolt and the hasp cooperates with another member extending from the back plate which other member has an opening to receive a bale portion of a padlock so as to lock the hasp and thereby the sliding bolt in position.

The type of padlock generally used for locking the bolt in position includes a U-shaped bale, the ends of which are slidably received in the body of the padlock. One end of the bale includes a hook and with the hook latched within the padlock body to retain the bale in the locked position. There are unfortunately a number of methods of breaking the padlock to thereby release the sliding bolt from the locked position. One method is to use a bolt cutter to cut the bale and thereby release the padlock. Another method is to use a hammer and punch against the padlock body to thereby unlatch the hook within the padlock body to in turn open the padlock and allow the sliding bolt to be opened.

In the past, rotatable covers have been provided for the sliding bolt mechanisms to attempt to cover at least the bale portion of the padlock to thereby prevent access to the bale portion so that the padlock will be protected from undesired tampering. The prior art rotatable covers have been generally cumbersome in construction and complicated in design and use. As an example, reference is made to prior art U.S. Pat. No. 3,953,062 issued Apr. 27, 1976 and listing John F. Maston as inventor. In U.S. Pat. No. 3,953,062, a rotating cover is attached to the sliding bolt. The rotating cover includes a bale support member which cooperates with a second bale support member attached to a back plate. The bale of the padlock passes through both bale support members to lock the sliding bolt in the locked position. In order to release the sliding bolt, the padlock must be removed and the sliding bolt and cover member rotated upward before the bolt can be slid to the open position. The cover plate is therefore not stationary and forms a part of the actual bolt sliding mechanism.

Another prior art sliding bolt with a protective cover also includes a rotating cover which must be rotated upward before the sliding bolt can be released. This type of structure is based on the simple sliding bolt and hasp structure described above. In this structure, the protective cover includes flange members which have openings through which the bolt can slide. The protective cover may therefore be rotated independent of any movement of the sliding bolt but this structure is also cumbersome and complicated in construction and difficult to use because of the necessity of rotating the cover before the bolt mechanism can be slid.

SUMMARY OF THE INVENTION

The present invention provides for an apparatus forming a garage door bolt with a stationary safety cover. With the apparatus of the present invention, the bolt may be slid between the open and the closed position and may be locked in either of these positions using a padlock. The padlock is protected by a stationary safety cover and the stationery safety cover prevents undesired access to the bale of the padlock. Once the padlock is opened and removed in a normal manner, the bolt may be slid between the open and closed positions without having to rotate the cover. The cover is actually welded in position across the face of the sliding bolt, and the sliding bolt plus the stationary cover may be relatively simple in construction and easy in operation.

The apparatus of the present invention is formed with a back plate for attachment to the garage door. The back plate includes a first upper pair of forwardly extending flange members having first openings to receive and support the bolt for sliding engagement with an exterior frame of a garage door or the like. The back plate also includes a second lower pair of forwardly extending flanges which lower flanges contain second openings which are designed to receive the bale portion of a padlock. The sliding bolt carries a flat member which is welded to extend in a perpendicular direction to the bolt. The flat member includes a first upwardly extending portion and a second bottomly extending portion. The bottomly extending portion includes an opening to correspond to the bale openings in the second lower pair of flanges and the bottomly extending portion is captured between the second pair of flange members. The upwardly extending portion is formed as a handle to allow the bolt to be slid back and forth. A stationary safety cover is welded across the face of the mechanism and is specifically welded to the ends of both the upper and lower forwardly extending flanges. The structure of the present invention allows the bale portion of the padlock to be protected by the safety cover and yet when the padlock is removed, the sliding bolt may be freely maneuvered between the opened and closed positions using the handle portion of the flat member.

BRIEF DESCRIPTION OF THE DRAWINGS

A clearer understanding of the present invention will be had with reference to the following description and drawings wherein.

DESCRIPTION OF THE PREFERRED EMBODIMENT

Figure 1:
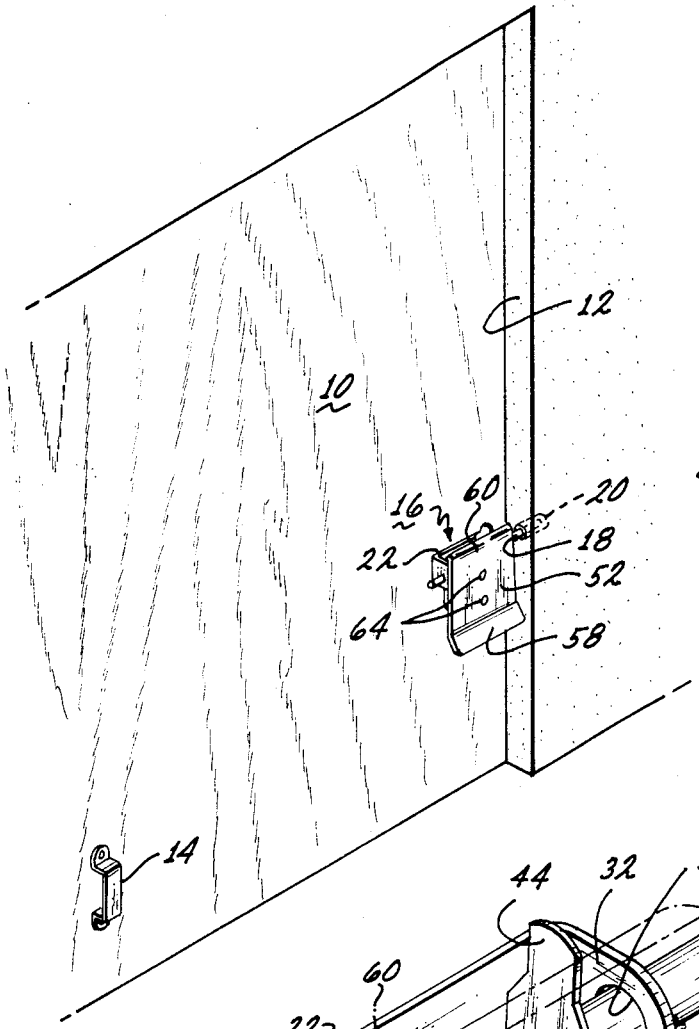
FIG. 1 is a front perspective view of apparatus forming a garage door bolt with stationary safety cover of the present invention and shown mounted on a garage door.
Figure 2:
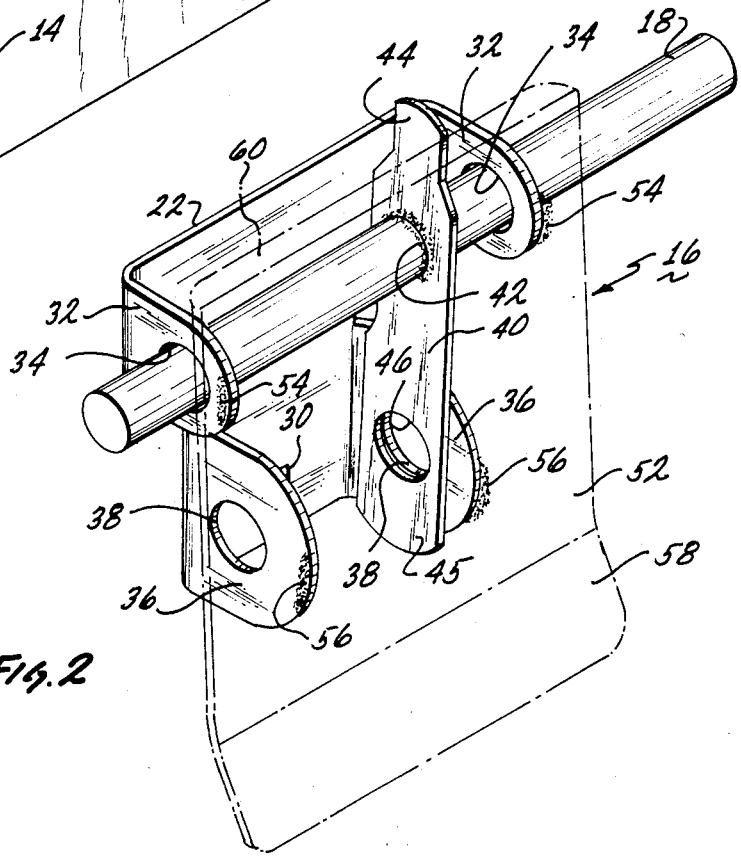
FIG. 2 is a front perspective view of the apparatus of the present invention and with the front stationary cover shown in dotted lines to reveal the interior of the apparatus.
Figure 3:
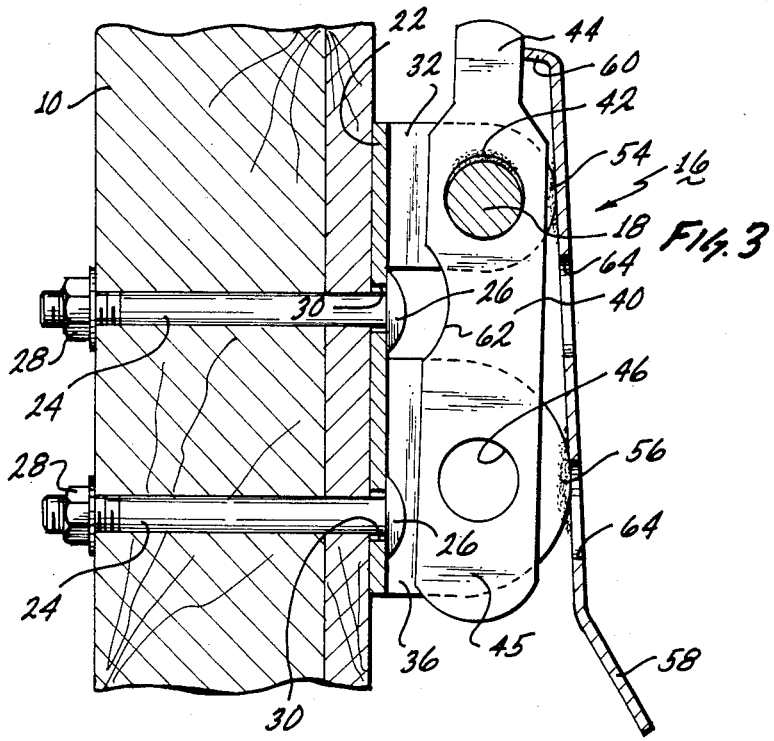
FIG. 3 is a side cross-sectional view of the apparatus of the present invention shown mounted to the garage door.

As shown in FIG. 1, a garage door 10 of the overhead type is illustrated mounted within a frame 12. A door handle 14, mounted on the door 10, would be used to pull the garage door up to open and pull the garage door down to close.

An apparatus 16, constructed in accordance with the teachings of the present invention, is shown to be formed as an open metal box and is mounted on the right hand side of the garage door 10. The apparatus 16 includes a sliding bolt 18 which is shown engaging an opening 20 in the frame 12 surrounding the garage door 10.

As shown in FIGS. 1 through 5, the apparatus 16 forming the open metal box includes a back plate 22, which back plate is mounted to the garage door by a pair of bolt members 24. The bolt members 24 include bolt heads 26 which do not include any slots so that the bolts 24 cannot be removed except from the interior of the garage. The bolts 24 are locked in position by nut members 28 which clamp the bolts 24 and the back plate 22 to the outside surface of the garage door 10. The back plate 22 includes square openings 30 to allow for passage of the bolts 24 but prevent the passage of the bolt heads 26.

Extending outwardly from the back plate 22 is a first upper pair of flange members 32. Each flange member 32 includes an opening 34 to receive and guide the bolt member 18 for sliding movement relative to the back plate 22. A second lower pair of flange members 36 also extend outwardly from the back plate 22 and with each of the lower pair of flange members 36 including an opening 38 for a reception of the bale portion of a padlock as shown in FIGS. 4 and 5.

A flat member 40 is attached by weld joints 42 to the sliding bolt 18. The flat member 40 includes an upwardly extending portion 44 to serve as a handle to control the sliding movement of the bolt 18. The flat member 40 also includes a downwardly extending portion 45 which includes an opening 46 which is aligned with the openings 38 in the flanges 36 to receive a bale portion of a padlock.

Figure 4:
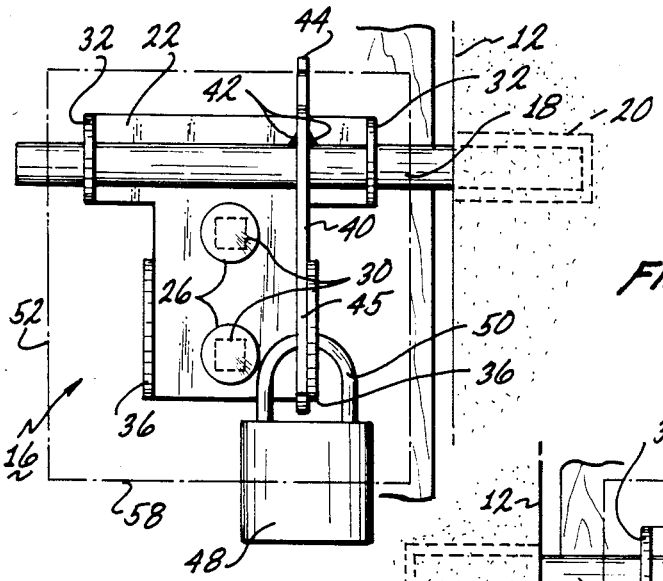
FIG. 4 is a front view of the apparatus of the present invention with the cover shown in dotted lines and mounted as a right side lock.
Figure 5:
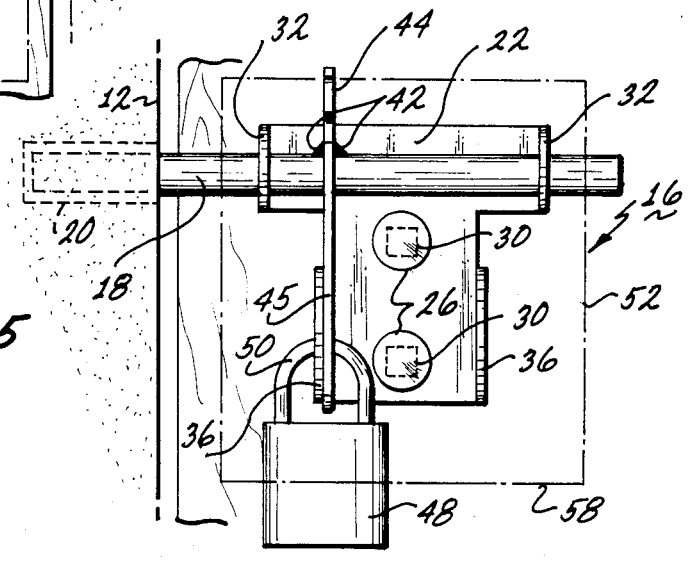
FIG. 5 is a front view of the apparatus of the present invention with the cover shown in dotted lines and mounted as a left side lock.

As shown in FIGS. 4 and 5, a padlock 48 having a bale portion 50 may be positioned to lock the garage door 10 within the frame 12 either in a right or left side position. As shown in FIG. 4, the bale portion 50 extends through the openings 38 and 46 with the bolt slid to the right, and with the apparatus 16 mounted on the right hand side of the garage door 10. FIG. 5 illustrates the apparatus 16 mounted to the left hand side of the garage door 10. The apparatus of the present invention may therefore be universally mounted on either the right or left hand side and with the flat member 40 cooperating with the left or right one of the flanges 36.

In order to insure that the padlock 48 is protected from any undesired tampering, the apparatus of the present invention includes a stationary protective cover 52. The protective cover 52 is welded in position to fully enclose the back plate 22, the flanges 32 and 36, the flat plate member 40 and the slide bolt 18. The protective cover 52 is welded in position using weld joints 54 between the cover and the upper flanges 32, and weld joints 56 between the lower flanges 36 and the cover 52. The cover 52 includes a bottom portion 58 which is bent outwardly to provide for easier access to the padlock 48. Specifically, the outward bend allows the padlock 48 to be rotated outward so that the key may be more easily inserted into the padlock. However, as can be seen in FIGS. 4 and 5, the bale portion 50 and the upper half of the body of the padlock 48 are fully covered by the safety cover 52 to thereby discourage any tampering with the padlock 48. The upper portion of the cover 52 is also bent towards the back plate 52, as shown at position 60, to further strengthen the cover, to partially cover the top of the sliding bolt and to provide a guide to prevent the flat member 40 from rotating too far forward which could provide for a gross misalignment between the opening 46 and the openings 38.

The flat member 40 also includes a slight relief portion 62 to insure that when the bolt 18 is slid using the handle 44, flat member 40 clears the head of the upper one of the bolts 24. In order to attach the apparatus 16 to the garage door, the cover 52 includes openings 64 which allow for the passage of the bolts 24 and the bolt heads 26 through the cover 52. The bolts 24 then pass through the square openings 30 in the back plate 22 so that the back plate 22 can be secured to the garage door 10.

Assuming that the garage door is locked, using the apparatus 16 and a padlock 48 as shown in either FIGS. 4 or 5, the garage door may be opened as follows:

The padlock 48 would be opened with the appropriate key and the bale 50 then removed from the openings 38 and 46. This now allows the bolt 18 to be freely slid out of engagement with the hole 20 in the frame 12 using the handle portion 44 of the flat member 40. When the bolt 18 is slid out of engagement, the padlock 48 may be stored on either of the flange members 36 until the apparatus would be used to relock the garage door. All this is accomplished with the stationary cover in position and with the movement of the sliding bolt 18 simply provided by the use of the handle portion 44 of flat member 40. The padlock 48 and specifically the bale portion 50 is always protected by the safety cover 52 and the entire structure is both simple in construction and simple in use.

It is to be appreciated that the member 40 may take other configurations other than that and need not include a handle portion since the downwardly extending portion 45 may be used to slide the bolt 18. Also the protective cover 52 may have other configurations and may be attached using other methods of attachment.

Although the invention has been described with reference to a particular embodiment, it is to be appreciated that various adaptations and modifications may be made and the invention is only to be limited by the appended claims.

We claim:

1. A sliding bolt with stationary safety cover for mounting on a door and for locking with a padlock having a bale portion, including a back plate including means for mounting the back plate on the door, an upper pair of flange members extending outwardly from the back plate and with each upper flange member including a first opening, a sliding bolt passing through and guided by the first openings in the upper pair of flange members, a lower pair of flange members extending outwardly from the back plate and with each lower flange member including a second opening for receiving the bale portion of the padlock, a handle and locking member attached to the sliding bolt and including a first upwardly extending portion forming a handle for sliding the bolt within the first openings in the upper pair of flange members and including a second downwardly extending portion located between the lower pair of flange members, the handle and locking member having a third opening corresponding to the second openings in the lower pair of flange members and with the third opening in association with either one of the second opening for receiving the bale portion of the padlock to lock the sliding bolt in either of two positions, and a stationary safety cover attached across the front of and spaced from the back plate to enclose the sliding bolt, the upper and lower pairs of flanges and the downwardly extending portion of the handle and locking member.

2. The sliding bolt with stationary safety cover of claim 1 wherein the means for mounting the back plate on the door includes at least one bolt having an enlarged head and also including an opening in the back plate of a size to pass the bolt but not the enlarged head and additionally including a complementary opening in the stationary cover of a size to pass both the bolt and the enlarged head.

3. The sliding bolt with stationary safety cover of claim 1 wherein the handle and locking member is formed as an elongated flat plate having an opening to receive the sliding bolt and extending upwardly and downwardly from the bolt and with the flat plate attached to the sliding bolt by at least one weld joint.

4. The sliding bolt with stationary safety cover of claim 3 wherein the upwardly extending portion of the flat plate is shaped to form the handle and the downwardly extending portion is relieved at at least one area to pass the means for mounting as the bolt is slid between the two positions.

5. The sliding bolt with stationary safety cover of claim 1 wherein the safety cover has a bottom portion bent outward away from the back plate to allow the padlock to be rotated outward about the bale.

6. The sliding bolt with stationary safety cover of claim 1 wherein the safety cover has a top portion bent toward the back plate to partially cover the top of the bolt and to guide the handle portion of the handle and locking member as the bolt is slid between the two positions.

7. The sliding bolt with stationary safety cover of claim 1 wherein the cover is attached across the front of the back plate by at least one weld joint between the cover and at least one flange of the pairs of flanges.

8. The sliding bolt with stationary safety cover of claim 7 wherein the cover is attached by weld joints between the cover and all four of the flanges forming the pairs of flanges.

9. An apparatus providing a sliding bolt, including an open metal box structure including a back plate, a front plate and side flanges, an upper portion of each of the side flanges including a first opening, a lower portion of each of the side flanges including a second opening, a sliding bolt located within the metal box and positioned within and extending through the first openings, a locking member located within the metal box and attached perpendicularly to the sliding bolt and including a downwardly extending portion having a third opening to line up with either one of the second openings in the side flanges, and means for mounting the back plate on a door and including at least one bolt having an enlarged head and also including an opening in the back plate of a size to pass the bolt but not the enlarged head and additionally including a complementary opening in the front plate of a size to pass both the bolt and the enlarged head.

10. An apparatus providing a sliding bolt, including an open metal box structure including a back plate, a front plate and side flanges, an upper portion of each of the side flanges including a first opening, a lower portion of each of the side flanges including a second opening, a sliding bolt located within the metal box and positioned within and extending through the first openings, a locking member located within the metal box and attached perpendicularly to the sliding bolt and including a downwardly extending portion having a third opening to line up with either one of the second openings in the side flanges, and the locking memaber formed as an elongated flat plate having an opening to receive the sliding bost and extending upwardly and downwardly from the bolt and with the flat plate attached to the sliding bolt by at least one weld joint.

11. The apparatus of claim 10 wherein the upwardly extending portion of the flat plate is shaped to form a handle.

12. An apparatus providing a sliding bolt, including an open metal box structure including a back plate, a front plate and side flanges, an upper portion of each of the side flanges including a first opening, a lower portion of each of the side flanges including a second opening, a sliding bolt located within the metal box and positioned within and extending through the first openings, a locking member located within the metal box and attached perpendicularly to the sliding bolt and including a dowwardly extending portion having a third opening to line up with either one of the second openings in the side flanges, and the front plate having a top portion bent toward the back plate to partially cover the top of the bolt and to guide the locking member as the bolt is slid between the two positions.

13. The apparatus of claim 12 wherein the front plate has a bottom portion bent outward away from the back plate to allow a padlock to be rotated outward about its hole.

14. An apparatus providing a sliding bolt, including an open metal box structure including a back plate, a front plate and side flanges, an upper portion of each of the side flanges including a first opening, a lower portion of each of the side flanges including a second opening, a sliding bolt located within the metal box and positioned within and extending through the first openings, a locking member located within the metal box and attached perpendicularly to the sliding bolt and including a downwardly extending portion having a third opening to line up with either one of the second openings in the side flanges, and the front plate attached across the front of the back plate by at least one weld joint between the cover and at least one flange.

15. The apparatus of claim 14 wherein the front plate is attached by weld joints between the cover and all of the flanges.

* * * * *